US007311570B2

(12) United States Patent
Csoke

(10) Patent No.: US 7,311,570 B2
(45) Date of Patent: Dec. 25, 2007

(54) AUTOMATIC SYSTEM FOR ADJUSTING THE TRIM OF A MOTOR BOAT

(76) Inventor: Lajos Csoke, 11-502 Bergamot Ave., Toronto (CA) M9W1W3

( * ) Notice: Subject to any disclaimer, the term of this patent is extended or adjusted under 35 U.S.C. 154(b) by 0 days.

(21) Appl. No.: 11/245,128

(22) Filed: Oct. 7, 2005

(65) Prior Publication Data

US 2007/0093149 A1 Apr. 26, 2007

(51) Int. Cl.
*B63H 5/125* (2006.01)

(52) U.S. Cl. ..... 440/61 G

(58) Field of Classification Search ..... 440/1, 440/53, 61 R, 61 S; 114/271, 285–287
See application file for complete search history.

(56) References Cited

U.S. PATENT DOCUMENTS 2,893,134 A * 7/1959 Shea et al. ..... 33/366.12
3,413,428 A * 11/1968 Noth ..... 200/83 T
3,468,282 A * 9/1969 Wintercorn ..... 440/1
3,494,526 A * 2/1970 Calvert et al. ..... 226/32
3,532,956 A * 10/1970 Simon ..... 318/609
3,641,965 A * 2/1972 Schmiedal ..... 440/2
4,129,982 A * 12/1978 de la Cruz ..... 368/225
4,318,699 A * 3/1982 Wenstadt et al. ..... 440/1
4,466,230 A * 8/1984 Osselaere et al. ..... 460/5
4,718,872 A * 1/1988 Olson et al. ..... 440/1
5,142,473 A * 8/1992 Davis ..... 701/21
5,171,172 A * 12/1992 Heaton et al. ..... 440/1
RE34,285 E * 6/1993 Olson et al. ..... 440/1
5,366,393 A * 11/1994 Uenage et al. ..... 440/1
6,594,232 B1 * 7/2003 Dupont ..... 370/224
6,884,130 B2 * 4/2005 Okabe ..... 440/61 H
2001/0047232 A1 * 11/2001 Kanno ..... 701/29

FOREIGN PATENT DOCUMENTS

JP 09251642 A * 9/1997

* cited by examiner

*Primary Examiner*—Jesus Sotelo
*Assistant Examiner*—Daniel V. Venne
(74) *Attorney, Agent, or Firm*—Sand & Sebolt

(57) ABSTRACT

The present invention is a system for automatically controlling the trim of a boat drive thrust on a boat by controlling the trim motor which adjusts the trim angle of the boat drive thrust by pivoting the boat drive thrust relative to the boat. The system includes a control unit operatively coupled to the trim motor. The control unit causes the trim motor to adjust the trim of the boat drive thrust towards the horizontal when the control unit is activated. A trim sensor is provided on the boat drive thrust to measure the trim of the boat drive thrust. The trim sensor is operatively coupled to the control unit and is configured to send an activation signal to the control unit to activate the control unit when the sensor senses that the boat drive thrust is at a predetermined angle from the horizontal. The trim sensor consist of a pendulum movable between first and second electronic contacts, the sensor being configured to send the activation signal when the pendulum engages one of the electronic contacts. The trim sensor further includes a dampening mechanism for slowing the movement of the pendulum.

11 Claims, 3 Drawing Sheets

Fig 3a
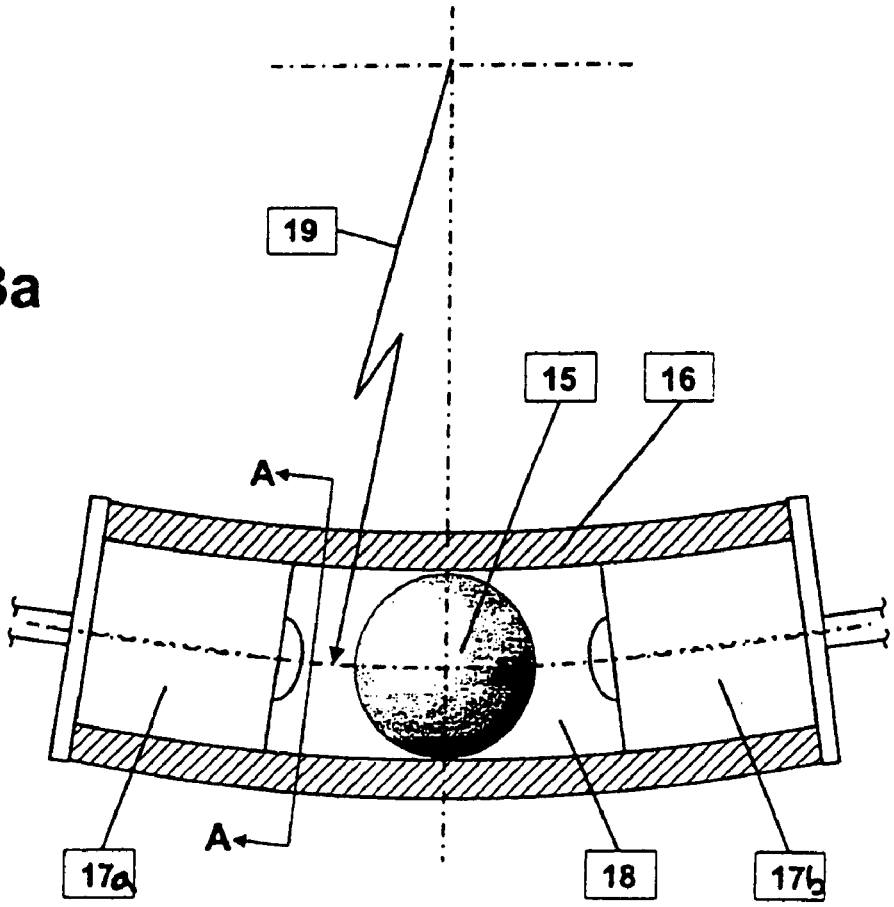
SECTION A-A
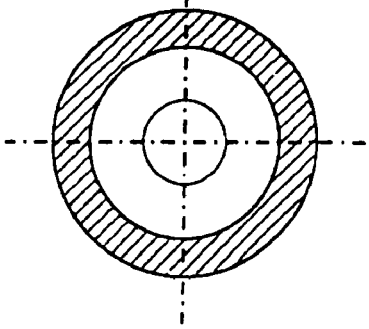
Fig 3b

AUTOMATIC SYSTEM FOR ADJUSTING THE TRIM OF A MOTOR BOAT

FIELD OF THE INVENTION

The invention relates generally to systems for automatically adjusting the trim of motor boats.

BACKGROUND OF THE INVENTION

It is a well known characteristic of motor boats that when under power, the bow of the boat tends to rise. As the bow of the boat rises, the angle of the boat changes and the angle at which the prop sits in the water changes, thereby decreasing the efficiency of the motor/prop combination. Ideally, the boat's prop is held horizontally in the water in order to maximize the efficiency of the prop and motor. With the prop held in a horizontal position, all of the propulsive force generated by the prop is directed horizontally in the desired direction. However, as the bow of the boat rises, the boat no longer remains horizontal with respect to the water, and the prop is placed at an angle. As a result, the propulsive force generated by the prop is no longer horizontally directed. Therefore, to maintain the maximum efficiency of the motor/prop, it is important that the prop be held as horizontally as possible. Various systems exist to manually adjust the trim of the boat drive while the boat is under power by means of electric motors or hydraulic actuators. These systems require the boat operator to estimate the desired trim angle and adjust the trim manually by means of the electric motors or hydraulic actuators.

There have been proposals for systems which automatic adjust the trim angle. These proposals are rather complex, usually involving subsystems for measuring the boats speed and micro-processors for calculating the optimum trim angle and controlling the trim motors. While potentially effective, these systems are expensive to implement. A simple system of automatic trim control is therefore required.

SUMMARY OF THE INVENTION

In accordance with the present invention, there is provided a system for automatically controlling the trim of a boat drive thrust on a boat by controlling the trim motor which adjusts the trim angle of the boat drive thrust by pivoting the boat drive thrust relative to the boat. The system includes a control unit operatively coupled to the trim motor. The control unit causes the trim motor to adjust the trim of the boat drive thrust towards the horizontal when the control unit is activated. A trim sensor is provided on the boat drive thrust to measure the trim of the boat drive thrust. The trim sensor is operatively coupled to the control unit and is configured to send an activation signal to the control unit to activate the control unit when the sensor senses that the boat drive thrust is at a predetermined angle from the horizontal. The trim sensor consist of a pendulum movably mounted between a pair of electrical contacts, the sensor being configured to send the activation signal when the pendulum engages one of the electronic contacts. The trim sensor further includes a dampening mechanism for slowing the movement of the pendulum.

With the foregoing in view, and other advantages as will become apparent to those skilled in the art to which this invention relates as this specification proceeds, the invention is herein described by reference to the accompanying drawings forming a part hereof, which includes a description of the preferred typical embodiment of the principles of the present invention.

DESCRIPTION OF THE DRAWINGS

FIG. 3*a*. is a long sectional view of the position sensor portion of the present invention.

FIG. 3*b*. is a cross sectional view of the position sensor portion of the present invention.

In the drawings like characters of reference indicate corresponding parts in the different figures.

DETAILED DESCRIPTION OF THE INVENTION

Figure 1:
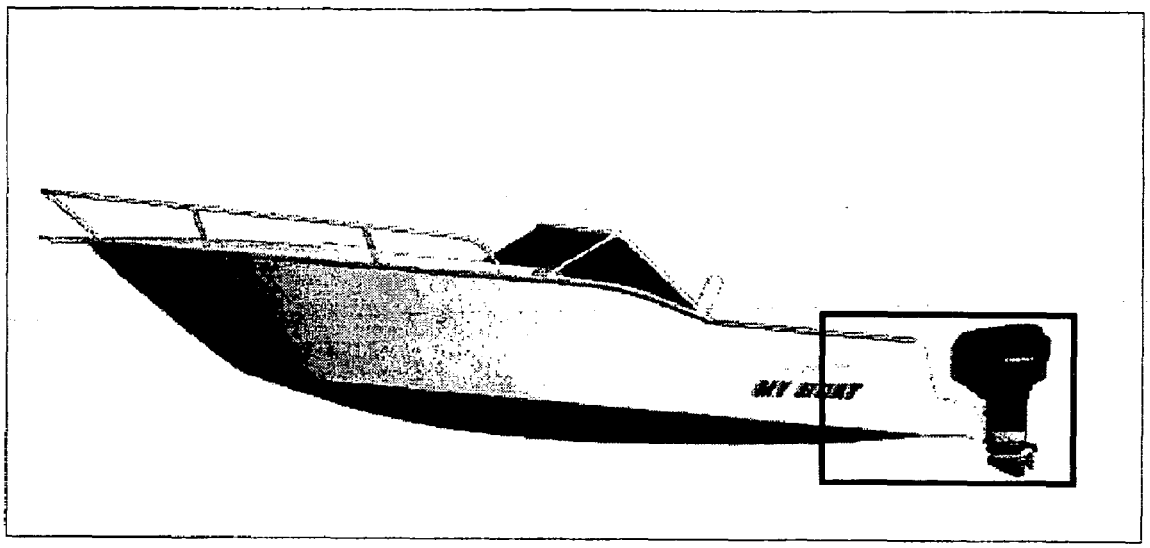
FIG. 1. is a side view of a motor boat having the automatic trim system of the present invention.
Figure 1:
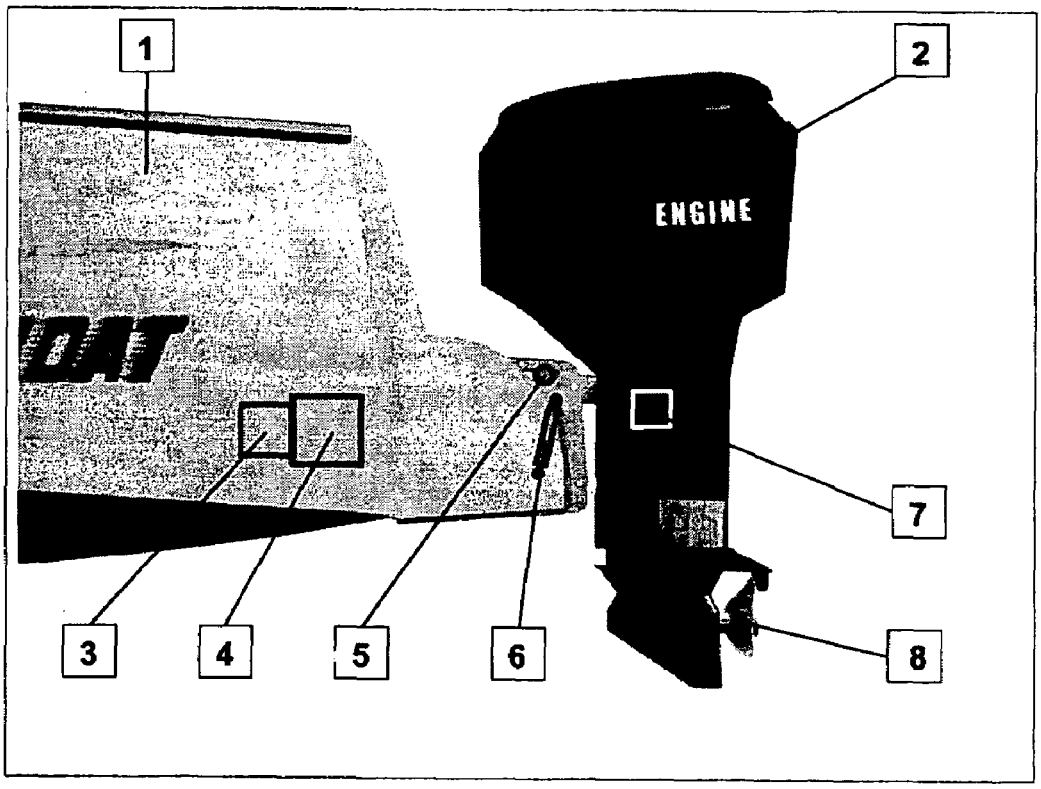

Referring firstly to FIG. 1, the system of the present invention consists of one or more trim drives 6 for adjusting the trim of boat drive 2 on boat 1. Trim drive 6 is designed to pivot drive thrust 8 about axis 5 to bring the drive inwardly or push it outwardly from the boat to change the angle of the drive thrust between an upwardly inclined angle and a downwardly declined angle. The system includes a sensor 7 mounted to boat drive 2 and a control unit 1 1 coupled to the sensor 7 for controlling the operation of trim drive 6 to achieve the optimum thrust position. Trim drive 6 is preferably a hydraulic cylinder which is operatively coupled to hydraulic pump 4 which in turn is driven by trim motor 3. Trim motor 3 and hydraulic pump 4 actuates hydraulic trim drive 6 to move a boat drive 2 IN or OUT. As indicated above, this control is predicated on the concept that the optimum trim angle is when the drive thrust 8 is in absolute horizontal position, parallel to water level and will result in best possible stability and the most favorable speed of the boat in motion through the water. Sensor 7 is configured to sense when drive thrust 8 is at an undesirable angle from the horizontal and to send an electronic signal to control unit 11 in response to the drive thrust 8 being out of its horizontal orientation. Control unit 11 is configured to operate trim motor 3 in response to the electronic signal in order to operate trim drive 6 to put drive thrust 8 back into a horizontal position.

Referring now to FIG. 3, sensor 7 consists of a pendulum 15 whose motion is dampened by a dampening mechanism. Pendulum 15 is contained within plastic tube 16 having radius 19. Tube 16 is filled with a viscous liquid 18. Tube 16 has two plug-type contacts 17*a* and 17*b* located on the opposite ends of tube 16. Contacts 17*a* and 17*b* comprise switches which are normally open. Pendulum 15 preferably consists of a metal ball. Tube 16 is arched such that pendulum 15 is in a neutral position between contacts 17*a* and 17*b* when the drive thrust 8 is in a horizontal position. When the driver thrust 8 deviates from the horizontal position, ball 15 in tube 16 moves along the tube and engages one of the Contacts 17*a* or 17*b* and thereby sends an electronic signal to activate the control unit 11. Depending on which contact is engaged, the electronic signal will cause the control unit 11 to operate trim drive 6 to pivot drive thrust 8 either towards boat 1 or away from boat 1 into a horizontal orientation. It will be appreciated that when on the water, boat 1 and boat drive 2 will oscillate relative to the horizontal as a result of wave action. The frequency and amplitude of the oscillation is related to the size of boat 1, the size of boat drive 2 and the size and frequency of the waves acting on the boat and any impulse waves which may impinge on the boat. If pendulum 15 were free to move within tube 16 without being impeded, pendulum 15 would repeatedly engage contacts 17*a* and 17*b* as a direct result of the oscillation of the boat drive 2. This would result in an uncontrolled activation of trim drive 6. Viscous liquid 18 acts as a dampener to slow the movement of pendulum 15 to prevent the inadvertent engagement of contacts 17*a* and 17*b* due to side effect such as the random oscillation of the boat. The greater the viscosity of liquid 18, the greater the dampening effect. Furthermore, the relative size of pendulum 15 and tube 16 contribute to the dampening effect. The closer pendulum 15 is in size to the inside diameter of tube 16, the greater the dampening effect. Therefore, the specific dampening effect of sensor 7 can be finely tuned by adjusting the viscosity of fluid 18 and the relative sizes of pendulum 15 and tube 16. Preferably, the dampening effect of sensor 7 is selected such that sudden oscillations caused by side effects such as sudden waves or passenger movements do not result in pendulum 15 engaging contacts 17*a* or 17*b*. In this way, oscillations caused by simple wave action can be "dampened" out and will not result in the activation of the trim drive 6.

Figure 2:
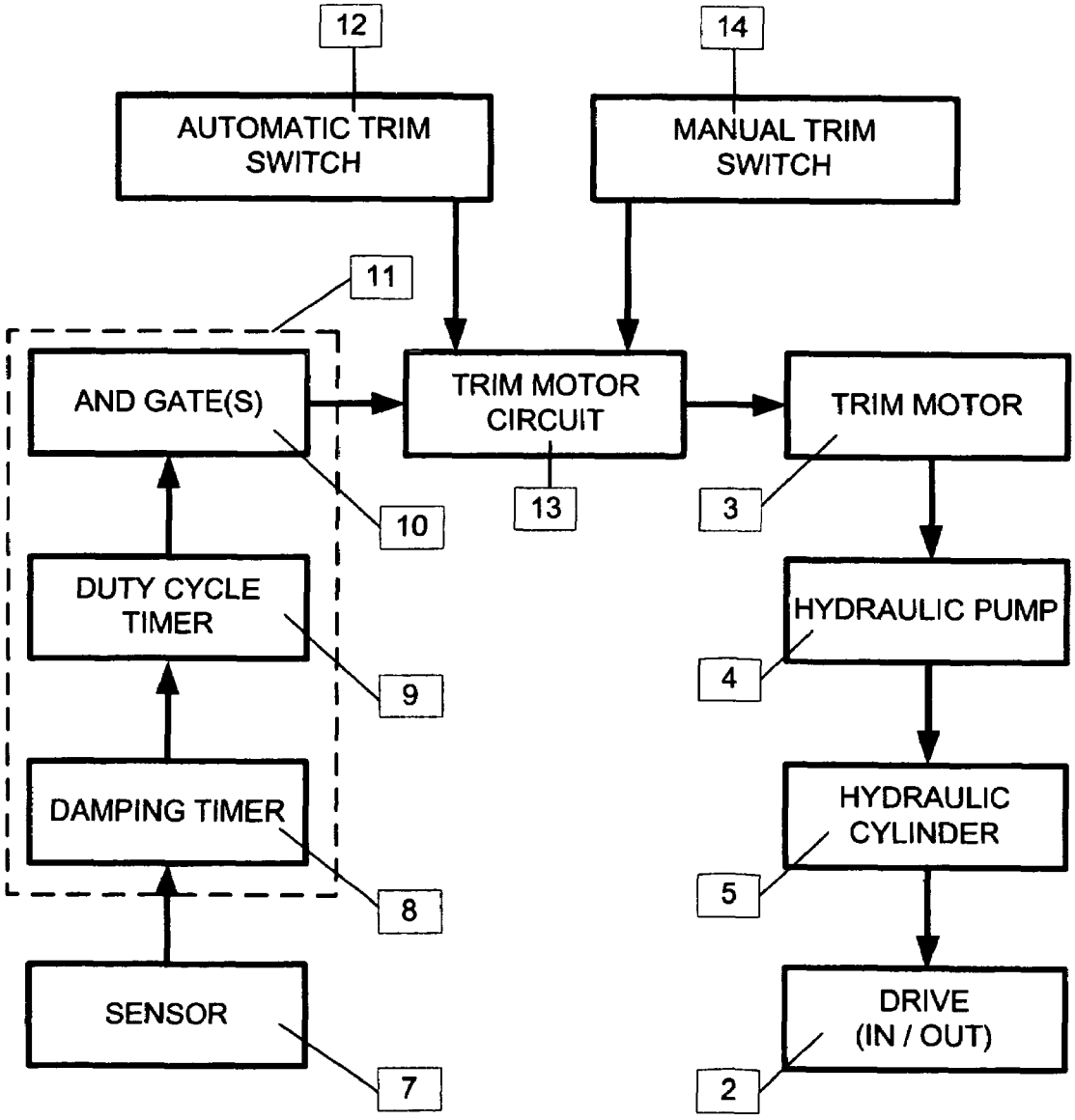
FIG. 2. is a schematic view of the system of the present invention.

Referring now to FIG. 2, control unit 11 consisting of a damping timer 20, a duty cycle timer 9 and AND Gates 10. AND Gates 10 outputs a signal to a trim motor circuit 13 which commands the trim motor 3 which runs the hydraulic pump 4 and activates the trim drive 6 to move boat drive 2 IN or OUT. The system is also provided with an automatic trim switch 12 having an ON and OFF position. The energized automatic trim switch 12 enables a signal to the trim motor circuit 13 and activates the automatic trim function. In case that any of the manual trim switches 14 are activated it will input a signal to trim motor circuit 13 and override the automatic trimming function. This gives the operator an opportunity to impose his/her wishes rather than accepting the automatic control. The trim motor circuit 13 remains de-activated until it is activated again by the operator trough automatic trim switch 12.

As shown in FIG. 2, when either of Contacts 17*a* and 17*b* of the sensor 7 are closed, the signal is received in damping timer 20 which verifies and confirms the signal continuity for pre-set time duration of a few seconds. Damping timer 20 provides a redundancy function to the system which enhances the system stability. The damping time preset duration shall be selectable. It will be appreciated that boat 1 may oscillate periodically for reasons which have nothing to do with the trim of the boat, such as passenger movement, waves or the like. By selecting the preset time to one or more seconds, inadvertent sensor signals caused by the accidental or inadvertent oscillation of the boat will not trigger the trim drive motor.

As shown in FIG. 2, damping timer 20 impulse are received in duty cycle timer 9. The output of this duty timer cycle 9 will be cyclically ON and OFF for preset time duration of a few seconds and shall be settable. When one of the Contacts 17*a* or 17*b* of the Sensor 7 is closed, and when the Damping timer 20 and the duty cycle timer 9 satisfy the pre-set conditions and are closed than the respective AND Gate 10 is activated simply taking the contacts in series and proceeding the signal to the trim motor circuit 13.

EXAMPLE

To test the invention, the automatic system for adjusting the trim of a motor boat as described above was applied to a test boat. The test boat consisted of 19 foot long boat having a dry weight of 1800 lbs, a fuel capacity of 50 gallons and driven by a 175 hp trim-able motor with a 14×21 inch propeller installed. The sensor consisted of a 13.2 mm diameter tubed bent to a radius of arch of 130 mm and filled with a liquid of dynamic viscosity 25 centistokes at 20 degrees C. A steal ball having a diameter of 12 mm was placed inside the tube and the ends of the tube were closed with plug-type contacts. The damping timer was set to 7 seconds and the duty cycle timer set to 2 seconds ON and 5 seconds OFF. Tests were done in light wind conditions with random waves of 1 to 2 feet in magnitude. The test boat performed well reaching a top speed of 47.3 MPH at 5200 rpm.

The present system has several advantages over the prior art. Firstly, the sensor is quite inexpensive to build, and being a very simple device, will have superior reliability. Also, since the sensor has a built in oscillation dampening mechanism with double redundancy and two-voting logics, the system will not be activated by false inputs. Finally, the system provides the automatic trim control of the boat motor drive without the costs of complicated electronic sensors. This automatic trim control is based on a unique electromechanical sensor that is able to recognize and filter out side effects of a boat-boat motor complex motion.

A specific embodiment of the present invention has been disclosed; however, several variations of the disclosed embodiment could be envisioned as within the scope of this invention. It is to be understood that the present invention is not limited to the embodiments described above, but encompasses any and all embodiments within the scope of the following claims.

Therefore, what is claimed is:

1. A system for automatically controlling a trim motor coupled to a drive thrust, said system comprising:

a control unit operatively coupled to the trim motor to cause the trim motor to adjust the trim of the thrust by pivoting the drive thrust toward a horizontal orientation when the control unit is activated; and a trim sensor mounted directly on the drive thrust to send an activation signal to the control unit to activate the control unit when the trim sensor senses the drive thrust is not horizontal, the trim sensor comprising a member movable between a pair of spaced-apart electronic contacts, the sensor being configured to send the activation signal when the member engages one of the electronic contacts, the trim sensor further comprising a dampening mechanism for slowing the movement of the member;

wherein the control unit comprises a manual override switch for deactivating the sensor and permitting manual adjustment of the drive thrust by manual operation of the trim motor; and wherein the control unit further comprises an electronic dampening timer for measuring a time length of the activation signal, the electronic dampening timer activating the control unit when the time length exceeds a predetermined time length.

2. The system of claim 1, wherein the dampening mechanism comprises a viscous liquid within which the member is immersed.

3. The system of claim 2, wherein the member comprises a weight contained in a tube having opposite first and second ends, the first switch located at the first end of the tube and the second switch being located at the second end of the tube, the tube being arched such that the weight lies between the opposite ends of the tube when the drive thrust is substantially horizontal, the weight being dimensioned to move within the tube between the first and second ends, the tube being filled with the viscous liquid.

4. The system of claim 3, wherein the weight comprises a metal ball.

5. The system of claim 3, wherein the relative dimensions of the weight and the tube and the viscosity of the liquid are selected such that the weight does not engage either of the switches when the drive thrust suddenly oscillates relative to the horizontal.

6. The system of claim 1, wherein the electronic dampening timer comprises:

a damping timer operationally connected to the sensor, said damping timer being adapted to verify and confirm the activation signal continuity from the sensor for a length of time; and a duty cycle timer operationally connected to the damping timer and to the trim motor; said duty cycle timer being adapted to transmit the signal from the damping timer to the trim motor circuit after a timed delay.

7. The system as defined in claim 6, wherein the length of time that is taken by the damping timer to verify and confirm the activation signal continuity from the sensor is selectable and is present.

8. The system as defined in claim 7, wherein the delay of the transmission of the signal from the damping timer to the trim motor by the duty cycle timer is selectable and present.

9. The system as defined in claim 8, wherein the duty cycle timer cycles between an on condition and an off condition.

10. The system of claim 6, wherein the electronic dampening timer further comprises at least one AND gate operationally connected to both the duty cycle timer and to the trim motor.

11. The system of claim 10, wherein the damping timer, the duty cycle timer, and the at least one AND gate are connected in series.

* * * * *